United States Patent [19]

Brown et al.

[11] Patent Number: 5,060,600

[45] Date of Patent: Oct. 29, 1991

[54] CONDENSER OPERATION WITH ISOLATED ON-LINE TEST LOOP

[75] Inventors: David S. Brown, Lexington; W. Cave Baum, Longview, both of Tex.

[73] Assignee: Texas Utilities Electric Company, Dallas, Tex.

[21] Appl. No.: 566,222

[22] Filed: Aug. 9, 1990

[51] Int. Cl.[5] ..... F22B 37/18; F22B 37/48

[52] U.S. Cl. ..... 122/379; 122/504; 122/1 R; 134/22.11; 165/1; 165/95

[58] Field of Search ..... 122/379, 504, 401; 134/22.13, 22.14, 22.11, 170; 165/1, 95

[56] References Cited

U.S. PATENT DOCUMENTS

| | | | |
|---|---|---|---|
| 4,599,975 | 7/1986 | Reeve et al. | 122/379 |
| 4,703,264 | 10/1987 | Edwards | 122/504 X |
| 4,920,994 | 5/1990 | Nachbar | 122/379 X |

*Primary Examiner*—Edward G. Favors

*Attorney, Agent, or Firm*—Worsham, Forsythe, Sampels & Wooldridge

[57] ABSTRACT

A condenser structure wherein both ends of at least one tube, which is physically located among the other (numerous) tubes of the condenser's tube bundles, is not connected to the inlet water box nor to the outlet water box; instead, this tube is provided with separate inlet and outlet connections. The separate inlet connection is preferably provided with a separately-controlled admixture of water treatment chemicals. Also disclosed is an innovative method of operating a steam condenser. One or more tubes, which are physically located among the other (numerous) tubes of the condenser, are isolated to provide a real-time test loop. The tube thus isolated is chosen to be among the tubes with the highest heat load, so that this tube provides a worst-case proxy for scaling in the other condenser tubes. The isolated tube is frequently inspected for scaling (e.g. at intervals of a week or so), and addition of anti-scaling chemicals to the cooling water is controlled with reference to the scaling (or lack thereof) seen in the isolated tube. Preferably the level of treatment chemicals is held at a lower level in the isolated test loop than in the primary cooling water supply.

20 Claims, 7 Drawing Sheets

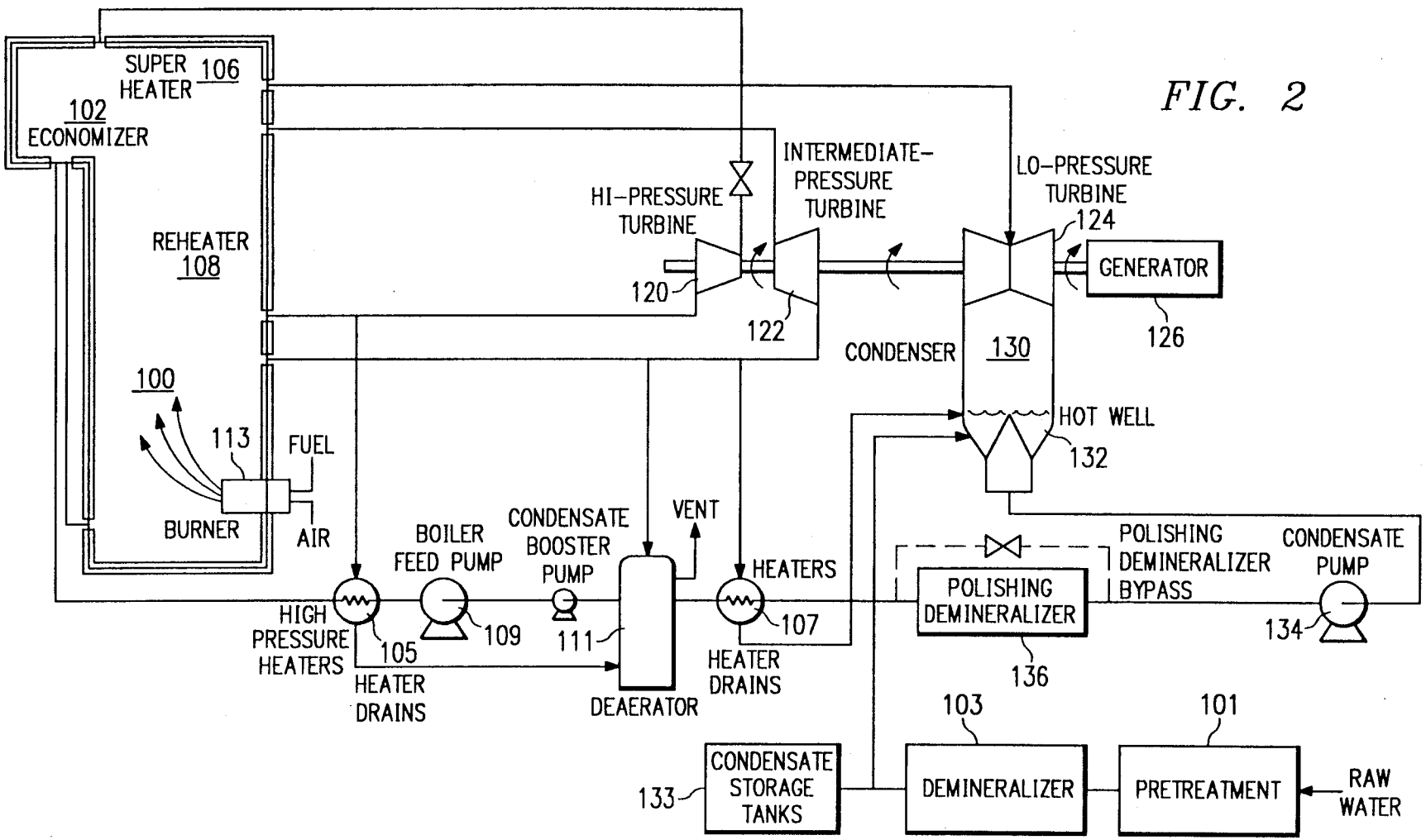
FIG. 2
GENERATOR
126
LO-PRESSURE TURBINE
124
130
HOT WELL
132
CONDENSER
INTERMEDIATE-PRESSURE TURBINE
122
HI-PRESSURE TURBINE
120
POLISHING DEMINERALIZER BYPASS
POLISHING DEMINERALIZER
136
CONDENSATE PUMP
134
RAW WATER
PRETREATMENT
101
DEMINERALIZER
103
CONDENSATE STORAGE TANKS
133
HEATERS
107
HEATER DRAINS
VENT
DEAERATOR
111
CONDENSATE BOOSTER PUMP
BOILER FEED PUMP
109
105
HEATER DRAINS
HIGH PRESSURE HEATERS
FUEL
AIR
113
BURNER
100
REHEATER 108
SUPER HEATER 106
ECONOMIZER 102

CONDENSER OPERATION WITH ISOLATED ON-LINE TEST LOOP

BACKGROUND AND SUMMARY OF THE INVENTIONS

The present invention relates to steam-fired power plants, and particularly to condensers for use in such power plants.

Overall Architecture of a Steam-Fired Generating Station

Most electricity generating stations in the world are steam powered. In a steam-powered power plant, a heat source is used to boil water, producing steam. This steam is then heated further, to produce "live" or "superheated" steam. This steam is passed through one or more turbines (or other energy extraction mechanisms), and the mechanical energy thus obtained from the steam is used to drive a generator to generate electricity.

The live steam will typically be passed through two or more turbine stages in series, to extract as much mechanical energy as possible from the steam flow. Thus, for example, a high-pressure turbine will typically be fed by the as-generated steam at its highest heat and pressure. The exhaust from the high-pressure turbine, which is at a lower heat and pressure, is fed to a low-pressure turbine (which is designed to make use of such lower-pressure steam flows). There may also be other stages, such as intermediate-pressure turbine, a re-heating cycle, a bottoming cycle (to extract the last economical bit of mechanical energy from the steam), and heat exchangers (which scavenge heat from the depleted steam for feed-water heating, process heat, or other such purposes), etc.

However, at some point, the steam's energy will have been used up. Such depleted steam is normally fed into a condenser. (A condenser is a type of heat exchanger, which cools the depleted steam so that it turns back into liquid water.) The liquid water has a much smaller volume than the gaseous steam it is condensed from. This volumetric drop in the condensor reduces the back-pressure seen at the last turbine stage, and thus provides improved energy extraction. Moreover, the water recovered by the condensor is relatively pure, and can be reused for boiler feedwater.

The heat of condensation, per pound of water, is large.[1] In a typical powerplant, the condenser must extract several million BTUs per hour, for each MW of generating capacity. This massive heat removal requires a correspondingly massive flow of colling water, and a correspondingly large surface for heat exchange.[2]

[1]The heat which must be extracted to condense a pound of water will be exactly equal to the amount of heat which must be applied to boil a pound of water, if the boiling and condensation take place at the same ambient pressure.

[2]For example, in the 545 MW baseload plant of the presently preferred embodiment, the design specification requires that the condenser condense 2,472,000 pounds of steam per hour. (Thus, the volume of steam flowing into the condenser will be several hundred thousand liters per second.) The condenser used, in this example, is a surface condenser with 326,000 square feet of cooling area. This cooling area is provided by 28,568 tubes, through which 323,637 gallons per minute cooling water are flowed. The cooling water is taken directly from a large lake, and therefore its temperature varies seasonally from about 60° F. to about 95° F. (In general, the cooling water flows are typically so large that they must be taken directly from a river, lake, or bay.) In coastal locations, ocean water is often used as a cooling water source; in such cases corrosion and biological fouling may be significant problems.

Condenser Architecture

FIG. 5 schematically shows the architecture of a surface condenser. Depleted steam from the exhaust of the low-pressure turbine, blows down across a stack of horizontal tubes 420. Each tube 420 has one end connected to an inlet water box 430, and the other end connected to an outlet water box 430. Cooling water is pumped into the inlet water box 430, and drained from the outlet water box 430, to remove heat from the condenser tubes. As the steam passes over the tube bundle, it is cooled below its boiling point (at the ambient pressure), and condenses. The resulting condensate is collected in a "hot well" 132 below the tube bundle.

In this architecture, the natural steam flow through the condenser is a downdraft. Thus, the tubes at the top of the bundle (which are closest to the turbine) will tend to have the highest heat burdens,[3] and thus will be the most susceptible to scaling.

[3]The whole surfaces of all the tubes exposed to the steam flow will be nearly the same temperature, but some of the tubes will be subjected to heat transfer at a higher rate than others.

Condenser Tube Structure

To promote efficient thermal coupling between the cooling water and the depleted steam, the condenser tubes are normally made of fairly thin-wall tubing.[4] Typically this tubing is made of stainless steel.

[4]For example, in the 545 MW sample embodiment, the condenser tubes are 22 gauge, and have a wall thickness of less than a sixteenth of an inch.

The condenser tubes also normally have a fairly small diameter,[5] to maximize the surface over which thermal coupling occurs. Therefore, water flow in the tubes is sensitive to blockage. Blockage can occur, for example, due to biological fouling or scale deposition.

[5]For example, in the 545 MW sample embodiment, the individual tubes have an outside diameter of 0.875 inches and a length of 50 feet.

The velocity of flow in the condenser tubes is typically rather high.[6] Such flow velocities imply that a large amount of shear will be present near the tube wall, and this shear condition helps to retard deposition of all kinds, including scale deposition and biofouling.

[6]For example, in the 545 MW sample embodiment, this velocity is specified at 6.9 feet per second. This will produce some turbulence in the first foot or so of the tube, and predominantly smooth flow thereafter.

However, reliance on high shear means that conditions can degrade rapidly. If any degradation process starts to cause obstruction, the resulting reduced flow will accelerate the course of all other deposition processes. In particular, the onset of biological fouling can cause greatly accelerate the progress of carbonate scaling.

Vibrational Loading

A condenser is inherently subject to high vibrational loads. In a large power plant, the steam turbines and the generator armature are necessarily massive, and are constantly rotating at a frequency which is locked to that of the electrical grid. (For example, in the U.S., a 500 MW turbine/generator set would typically include several tons of mass rotating at 3600 rpm.) At this scale, even a well-balanced piece of machinery is still likely to apply significant vibrational forces, at 60 Hz and 120 Hz, to its support. Moreover, no matter how well balanced a large generator may initially be, imbalances may appear in service from bearing wear or inelastic mechanic deformation. Since the steam inlet to the condenser is necessarily closely coupled to the steam exhaust from the turbine, the condenser will normally also be coupled to the vibration generated by the rotating machinery. Variation in the steam flow, due to combustion irregularities or acoustic resonances, may also sometimes be seen at the condenser. Normally a large rubber isolation element is used to reduce the mechanical coupling of vibration from the turbine to the condenser, but the vibration forces can still be quite large. Vibration is highly variable from unit to unit, and can even change fairly rapidly, over a period of time, at a given unit.

Normal condenser structures can withstand such vibrational loads over long periods of time. Any modification to the condenser structure must also be able to withstand the vibrational loads. This can be difficult.

The Chemistry of Scaling

It is normally desirable not to have too large a temperature rise in the cooling water. A large temperature rise may be regarded (for purposes of environmental regulation) as "thermal pollution," and regulated accordingly. Moreover, it is desirable to keep the cooling water temperature far below boiling, to ensure 100% condensation of the steam. Thus, for example, in typical North American practice the temperature rise in the cooling water is typically held to 20° F. or less.

However, even a moderate degree of temperature rise can cause some significant problems. Any natural source of water will contain a significant fraction of dissolved ionic species, such as $Na^+$, $Ca^{++}$, $CO_3^{-2}$, $Cl^-$, and many others. As the water temperature rises, some of these impurities will precipitate out.

Most common ionic salts have increasing solubility with temperature, and therefore will not tend to precipitate upon heating. However, some compounds exhibit decreasing solubility with temperature. (This phenomenon is known as "retrograde solubility.") If cooling water contains a large amount of such a compound, the compound may come out of solution, and form solid deposits, if the water is heated sufficiently. A large condenser may heat the cooling water by enough to cause formation of solid mineral deposits. Such deposits are known as "scale."

The most common scale-forming dissolved mineral is calcium carbonate.[7] However, a number of other minerals can also cause scaling problems, under various water conditions. For example, other calcium salts, including calcium sulfate ($CaSO_4$) and calcium phosphate ($Ca_3(PO_4)_2$) can also form scale. Magnesium sulfate ($MgSO_4$), iron oxide, and manganese dioxide[8] also sometimes occur.

[7]In the chemistry of these depositions, the mineral which forms the solid deposits is not necessarily identical to the minerals which were dissolved into the water in the first place. Calcium carbonate ($CaCO_3$) can be deposited whenever the product of the calcium ion concentration and the carbonate ion concentration reaches a certain temperature-dependent value, regardless of what the original source of the ions may have been.

[8]Dissolved iron is normally present as the "ferrous" ion $Fe^{++}$. When the water is warmed, these ions may be oxidized to the "ferric" ion $Fe^{+++}$. Since the ferric ion $Fe^{+++}$ is much less soluble than the ferrous ion $Fe^{++}$, this reaction is likely to lead to precipitation. A similar oxidizing reaction leads to deposition of manganese dioxide.

Consequences of Scale Formation

As scale forms on the inside of the tube, the flow of cooling water is restricted. Moreover, since the scale provides some thermal insulation, the efficiency of thermal transfer is impaired. Once scale has formed, it is fairly hard, and is difficult to remove by mechanical means: normally treatment with fairly strong acids is necessary.

Using Cooling-Water Additives to Reduce Scaling

A variety of chemical additives have been used to reduce scale formation. See generally Thayer, "Water Treatment Chemicals: Tighter Rules Drive Demand," *Chemical & Engineering News*, Mar. 26, 1990, which is hereby incorporated by reference. However, these additive chemicals impose an additional cost, which can be large in a large facility.

The chemistry of water supplies (and therefore the chemistry of scale formation) varies significantly from site to site, and from season to season, and even sometimes from week to week. Moreover, the heat transfer dynamics of different condenser designs will be different, and the degree of scale formation in any specific tube will be dependent on the degree of heat burden carried by that tube. (The water treatment must be sufficient for the worst case possible.) Thus, the amount of water treatment needed, at some specific installation for some specific week, cannot be accurately predetermined.

The normal approach to this problem is to use a quantity of water treatment which is more than sufficient. However, this approach wastes money. For example, conventional cooling water treatment methods at a 1000 MW plant can cost $ 1,000,000 per year or more for chemicals.

The inventions disclosed in this patent application permit the admixture of cooling water treatment chemicals to be controlled far more precisely. This has two advantages: the cost of chemicals is reduced; and the reliability of scaling control is increased, reducing the downtime required for descaling.

Efforts to Model, Predict or Observe Scaling

Because scaling is dependent on the chemistry of the cooling water intake, and also on the detailed thermal profile of the condensor in service, it is not easily predictable.

Emulation with an Observable Compact Physical Model

Many attempts have been made to provide a model which can track the scaling behavior of a real condenser tube. These physical models will typically use a tube of manageable size (3 to 6 feet long), through which a sidestream from the cooling water source is flowed, while the test tube is given a heat load which is estimated to match that of a worst-case condenser tube. However, since the fluid dynamics of the condensing steam are not accurately known, there is no assurance that the dynamics of deposition in the test tube will match the dynamics of deposition in the actual condenser tubes.

Computer Simulation

Attempts have also been made to devise some mathematical model which would predict the scaling behavior of a real condenser tube. However, this problem is not susceptible to accurate modeling at present, and will not be in the near future. As of 1990, accurate simulation of fluid flow normally requires a supercomputer, and even supercomputers cannot normally approach real-time simulation. Accurate direct simulation of condenser behavior would require simulation of a flow of condensing steam over a complex heat sink shape (with spatially varying thermal conductivity), and might also require simulation of the fluid flow of the cooling water under spatially varying heat inputs. It will be many years before real-time simulation of such complexity is available at any reasonable price.

Inspection of Scaling

Since the commercialization of fiber optic illumination sources, endoscopic inspection has come into widespread use. Currently available systems provide a fiber optic conduit for illumination, and a compact CCD imaging chip, with lens, in the probe head. Endoscopic inspection of condenser tubes in situ has previously been described.

Condenser with Isolated Tube of In-Situ Scale Control Testing

Among the innovative teachings set forth herein is a condenser structure wherein at least one tube, which is physically located among the other (numerous) tubes of the condenser's tube bundles, is not connected to the inlet water box nor to the outlet water box; instead, this is provided with separate inlet and outlet connections.

Among the innovative teachings set forth herein is a method of operating a condenser wherein the cooling water flow through one or more tubes, which are physically located among the other (numerous) tubes of the condenser, is isolated to provide a real-time test loop. The tube thus isolated is chosen to be among the tubes with the highest heat load, so that this tube provides a worst-case proxy for scaling in the other condenser tubes. The isolated tube is frequently inspected for scaling (at intervals of a week or so), and addition of anti-scaling chemicals to the cooling water is controlled with reference to the scaling (or lack thereof) seen in the isolated tubes. Preferably the level of treatment chemicals is held at a lower level in the isolated test loop than in the primary cooling water supply.

Water flow in the monitored tube is preferably isolated by using isolation tubes. One isolation tube reaches through the inlet water box, to mate with one end of the monitored condenser tube; and the other isolation tube reaches through the outlet water box, to mate with the other end of the monitored condenser tube. These isolation tube emplacements—unlike the inspection tubes described below—are semi-permanent installations. Endoscopic inspection of the monitored tube can be performed at any time, simply by inserting the flexible probe through the isolation tube into the monitored tube.

In an early experiment, the present inventors used an isolation tube with a tapered tip, and wedged this tip into the end of the monitored tube. The other end of the isolation tube was welded to the water box endwall. However, the vibration present was so high that the weld broke.

In another early experiment, the present inventors used rubber to support the isolation tube through the water box endwall. The other end of the isolation tube had O-rings to provide a hydraulic seal to the end of the condenser tube, but also had some metal-to-metal contact with the condenser tube. In this case, the condenser tube wore through and failed at the site of the metal-to-metal contact.

Innovative Through-Water-Box Tube Inspection Probe

Among the innovative teachings disclosed herein is a condenser mechanical structure which permits endoscopic examination of condenser tubes in situ, without taking any part of the condenser off-line (except the specific tube being examined). This is accomplished by providing one or more inspection ports in the outlet water box, and providing a hollow rigid inspection probe which can be inserted through the outlet water box to dock with the end of a tube in the condenser. A flexible endoscopic probe can then be inserted through the rigid probe, to inspect the interior of the tube thus accessed.

In operation, massive water flows will be present in the outlet water box. A wall of falling water, which may be six feet or more thick, will be present between the water box's endwall and the ends of the lower tubes in the tube bundle. Thus, any probe which is inserted through this water box in operation will encounter a significant downward deflection force.

If water flow is efficient, the outlet water box will normally be under a slight vacuum (due to the siphoning effect of the drain). Thus, inspection ports in the outlet water box require only cover plates, and do not even require valves (although gate valves may be used if desired). Thus, inspection through the outlet water box is more convenient. If the endoscopic probe is long enough, it is not necessary to access tubes through the inlet water box at all (at least not for endoscopic inspection access).

The inlet water box will normally be under a few psi of pressure. Thus, inspection ports in the inlet water box are preferably built using modest-sized gate valves (e.g. 2" or 3" gate valves). When the valve is opened to insert the inspection probe, some water will pour out, but this flow can be stemmed when the inspection probe is in place.

Monitoring and Control of Biological Fouling

A related problem in cooling water treatment is the control of biological fouling. Unless precautions are taken, the cooling water path may provide sites for biological growth which will reduce flow and heat transfer. Typically the first organisms to appear will be bacterial colonies, of the type which excrete a protective slime coating. This slime provides an adherent site which collects various forms of debris. Thereafter, in an uncontrolled situation, other life forms may appear, including higher plants or even barnacles. Biological fouling can be avoided with a variety of additives, such as sodium hypochlorite or bromide salts. However, such additives are not free.

Monitoring and Control of Corrosion

Another related problem in cooling water treatment is the control of corrosion. The progress of corrosion will be dependent on factors such as water temperature, oxygen content, salinity, and pH. It is possible to coat the tube interiors to help control corrosion, but the needed additives have a significant cost. Moreover, coating the tube interiors tends to reduce thermal transfer efficiency.

BRIEF DESCRIPTION OF THE DRAWING

The present invention will be described with reference to the accompanying drawings, which show important sample embodiments of the invention and which are incorporated in the specification hereof by reference, wherein:

FIG. 2 is slightly more detailed schematic view of such a steam-powered electric generating station, showing additional details of condensate and feedwater handling.

FIG. 2 is slightly more detailed schematic view of a steam-powered electric generating station, showing additional details of condensate and feedwater handling.

FIG. 3 is a schematic flow diagram of a sample 545 MW baseload steam-powered electric generating station, showing flows, temperatures, and pressures at various points of the water and steam flows.

DESCRIPTION OF THE PREFERRED EMBODIMENTS

The numerous innovative teachings of the present application will be described with particular reference to detailed implementation of the presently preferred embodiment, wherein these innovative teachings are advantageously applied to the particular problems of an 545 MW lignite-fired baseload generating station.[9] For clear understanding of this example, very specific details will be given. However, it should be understood that this embodiment provides only one example of the many advantageous uses of the innovative teachings herein. In general, statements made in the specification of the present application do not necessarily delimit any of the various claimed inventions. Moreover, some statements may apply to some inventive features but not to others.

[9]The particular example referenced receives cooling water from a lake which is highly prone to scaling. Thus, this site provides a good test of scaling control.

Figure 1:
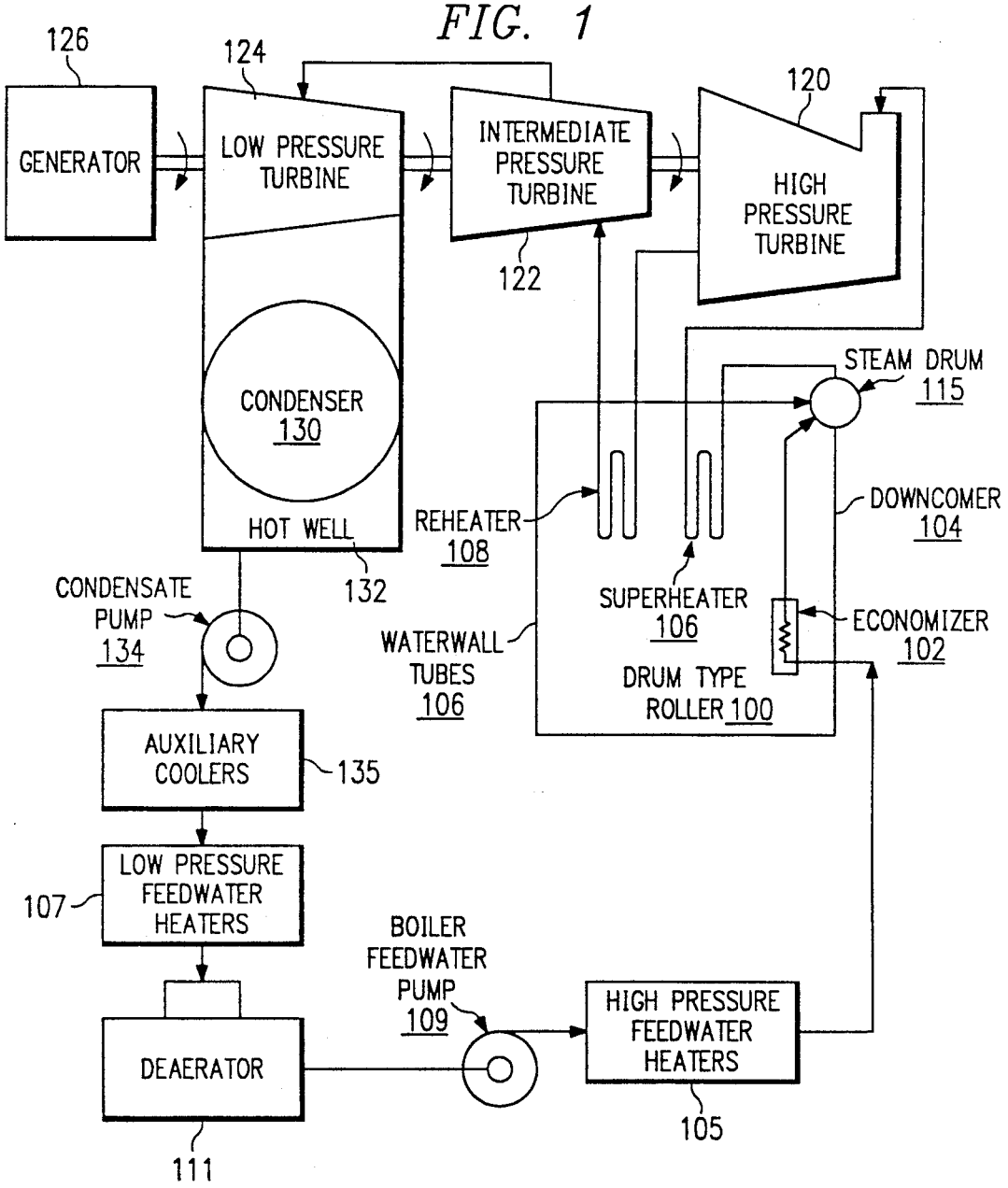
FIG. 1 is an overall schematic view of a steam-powered electric generating station which may contain the disclosed innovations.
Figure 3:
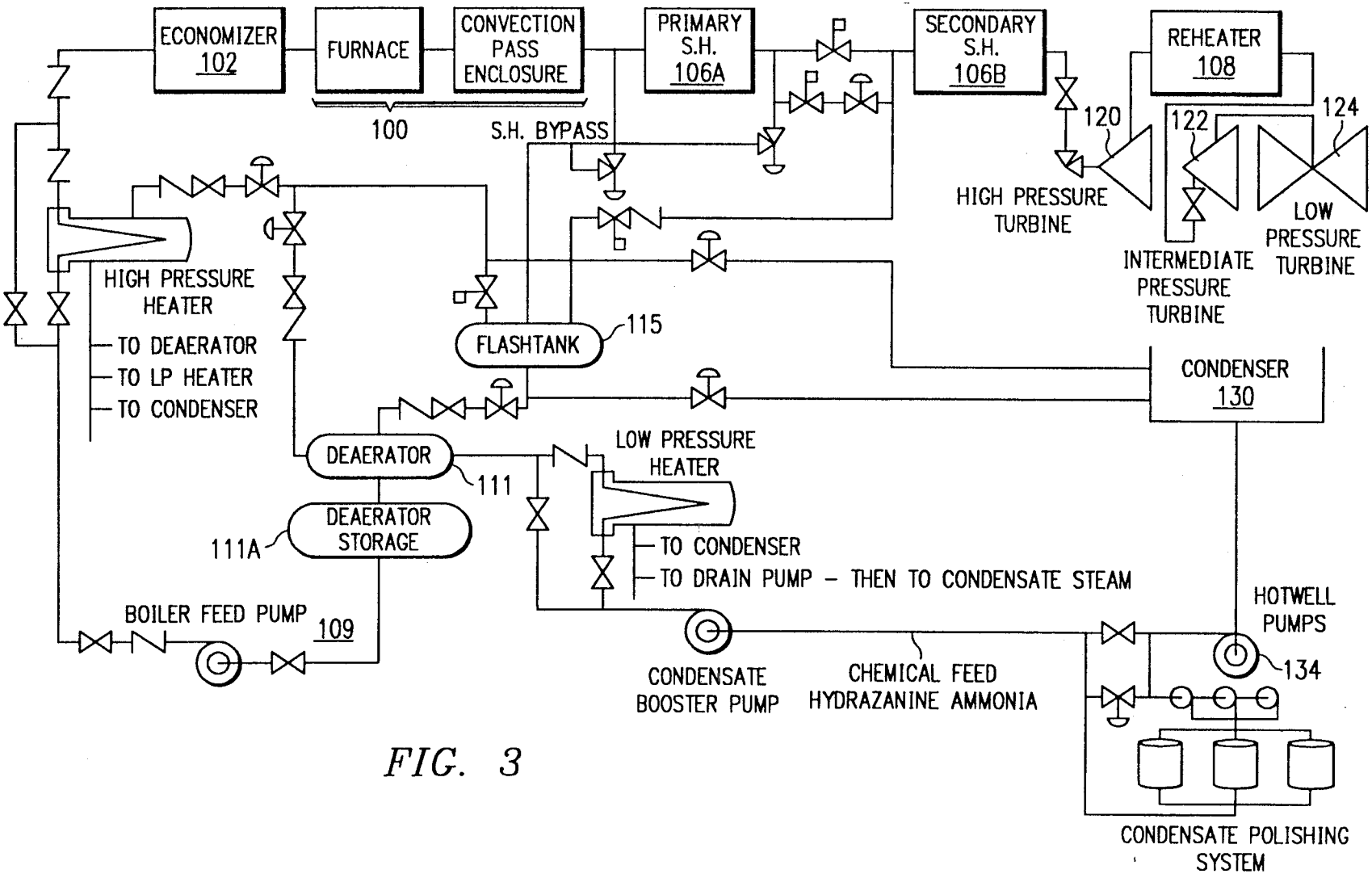
FIG. 3 schematically shows some important control points in such a system.

FIG. 1 is an overall schematic view of a steam-powered electric generating station which may contain the disclosed innovations; FIG. 2 is slightly more detailed schematic view of such a steam-powered electric generating station, showing additional details of condensate and feedwater handling; and FIG. 3 schematically shows some important control points in such a system.

A boiler 100 is supplied by feedwater pump 109 with slightly more than 4,000,000 pounds per hour of pressurized feedwater, at a pressure of about 4300 psia. The feedwater is heated by multiple feedwater heaters 107 and 105 to a temperature of about 500° F. Further heating occurs in economizer 102, and the water is volatized to form steam. Steam drum 115 provides a stabilizing volume to damp pressure surges. Note that downcomer and waterwall tubes 104 and 106 provide good scavenging of the heat generated by burner 113.

The steam is further heated in superheater 106, to about 1000° F., and fed to high-pressure turbine 120. The pressure at the intake to this turbine is about 3675 psia, and the pressure at the exhaust is slightly over 700 psia. The exhaust from the high-pressure turbine 120 is passed through reheater 108 and provided to the intake of intermediate-pressure turbine 122. The temperature at the intake to intermediate-pressure turbine 122 is about 1000° F., and the pressure at this turbine's exhaust is slightly over 175 psia. The exhaust from the intermediate-pressure turbine 122 is provided to the intake of low-pressure turbine 124. The exhaust from the low-pressure turbine 124 is at a fairly constant temperature of about 160°-165° F., and is fed directly into the condenser 130. (The low-pressure turbine, in the presently preferred embodiment, sits directly on top of the condenser 130.) The pressure at the exhaust of the low-pressure turbine 124 is slightly negative—less than atmospheric—due to the volumetric change which occurs in the condenser 130. At the hot well 132, the temperature will no more than 140° F. (and typically about 125° F.), and the absolute pressure will be about 3 inches of Hg. (This is a vacuum of about 13 psi relative to the atmosphere.) The condensate is then pumped (by pump 134) through minimal further processing stages 133 and 136, into the low-pressure feedwater heater 107, deaerator 111, feedwater pump 109, and high-pressure feedwater heater 105. Thus, most of the boiler's feedwater is recycled condensate. This is supplemented by raw water, processed through pretreatment 101 and demineralizer 103.

Figure 5:
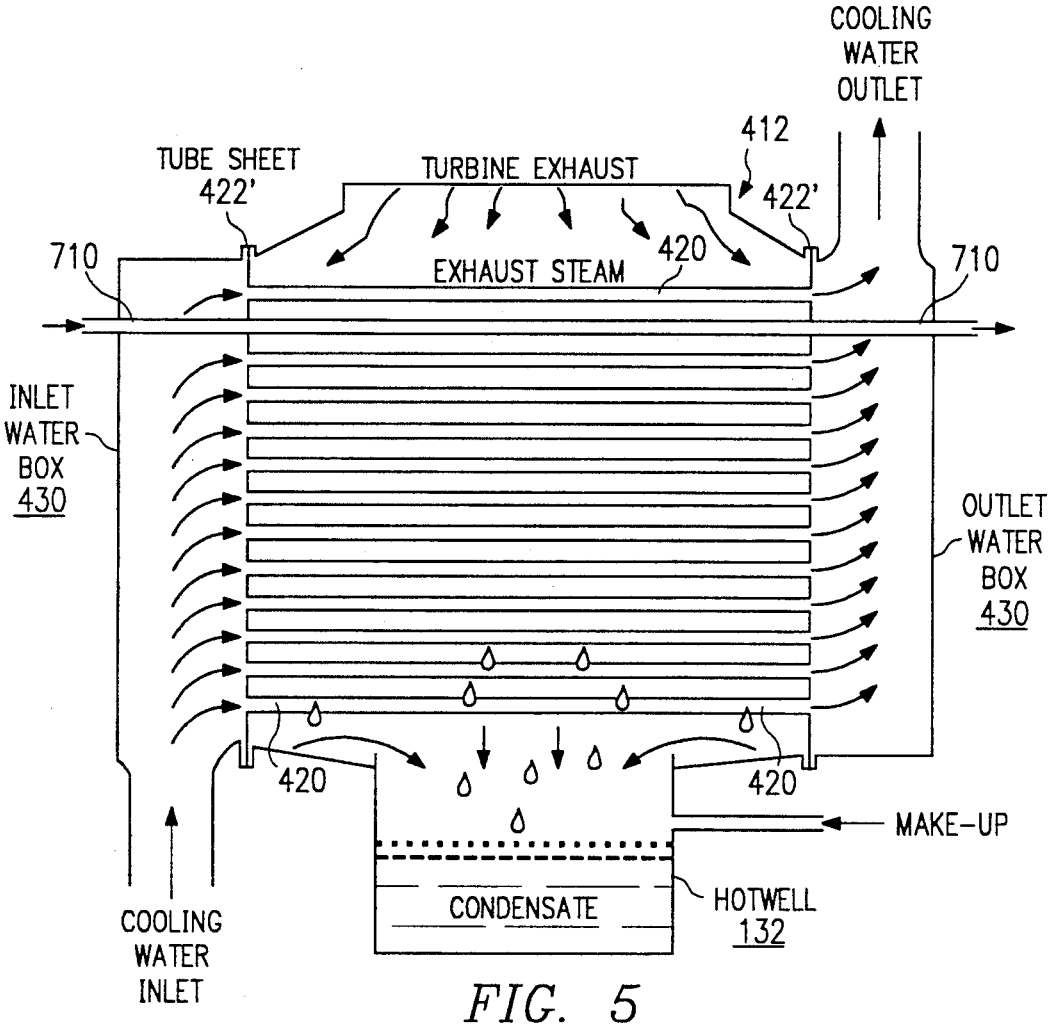
FIG. 5 is a schematic sectional view of the flows of water and steam in a condenser.

FIG. 5 is a highly simplified schematic sectional view of the flows of water and steam in a condenser. Cooling water flows from inlet water box 530, through the condenser tubes 420, into an outlet water box 430. Each of the tubes is supported at its ends by endpoint tube supports 422', and these endpoint tube supports 422' also serve to isolate the water boxes 430 and 530 from the interior of the condenser. In the interior of the condenser, depleted steam contacts the cold tubes 420, and condenses into water, which is collected in hot well 132. FIG. 5 also shows the two isolation conduits 710 which, according to the innovative teachings herein, are inserted into both ends of a tube 420, to create an isolated test loop.

Figure 4:
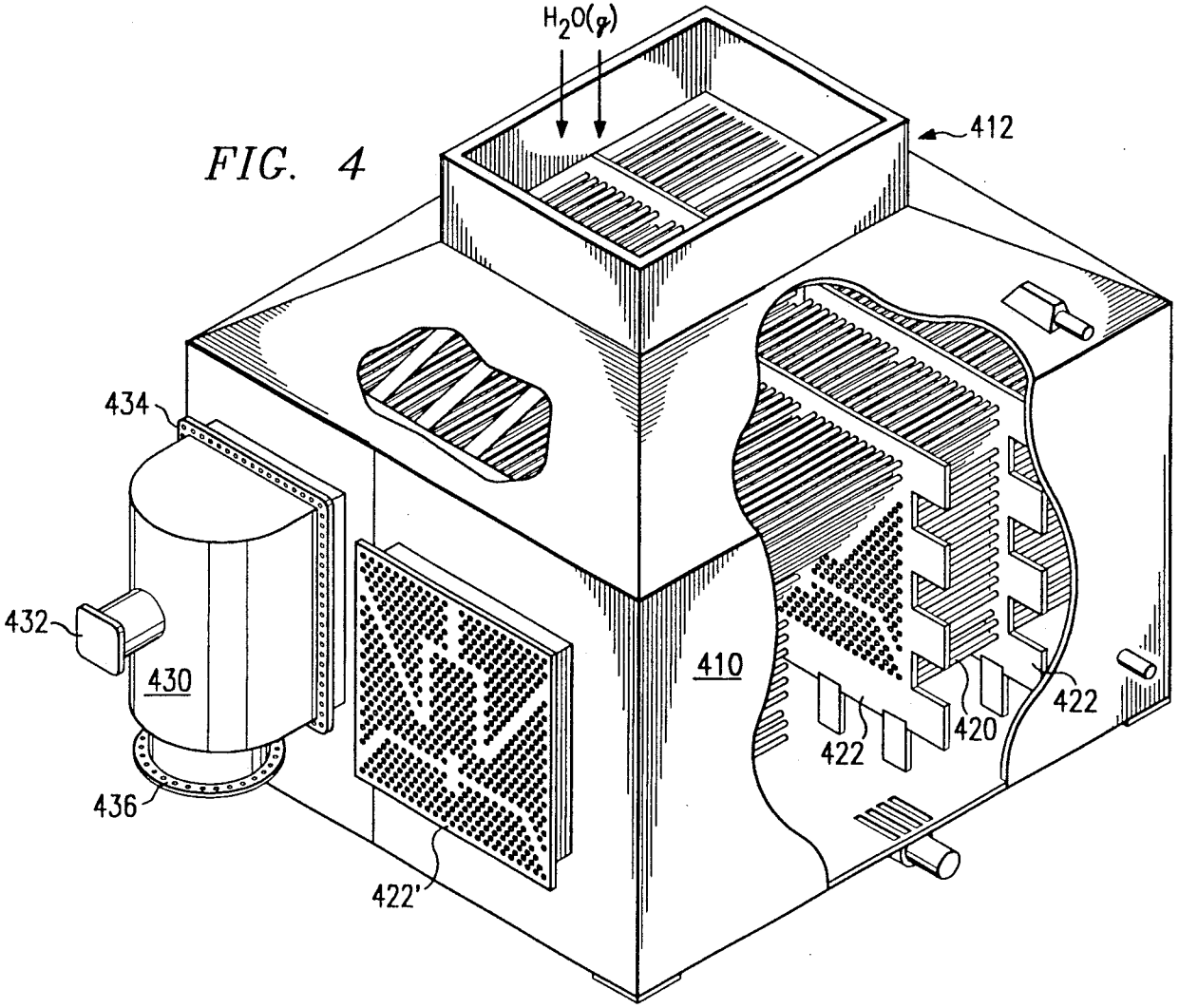
FIG. 4 is a perspective view of a typical large condenser, such as would be used in the generating station of FIG. 1.

FIG. 4 is a perspective view of a typical large condenser, such as would be used in the generating station of FIG. 1. The exterior of the condenser is a vacuum vessel 410. Inlet hood 412 receives the steam exhausted from the low-pressure turbine 124. The steam condenses as it contacts the cold condenser tubes 420 (which are supported by tube supports 422).

Each of the tubes, in the presently preferred embodiment, is 50 feet long, and is supported along its length by multiple tube supports 422. At the final tube support 422' for each bundle if tubes, a flange is provided which mates with the flange 434 on an outlet water box 430. The example shown includes two bundles of tubes 420, so that two outlet water boxes 430 would actually be used; but for clarity, only one outlet water box 430 is shown, so that the end of one bundle of tubes can clearly be seen.

The massive flow of steam through hood 412 keeps the box 410 filled with steam. The volumetric change as the steam condenses causes a continuous radial inflow toward the center of each of the tube bundles. (This flow will be parallel to each of the tube supports 422.) The liquid water which results from this condensation is collected in a hot well, as described above.

Figure 6:
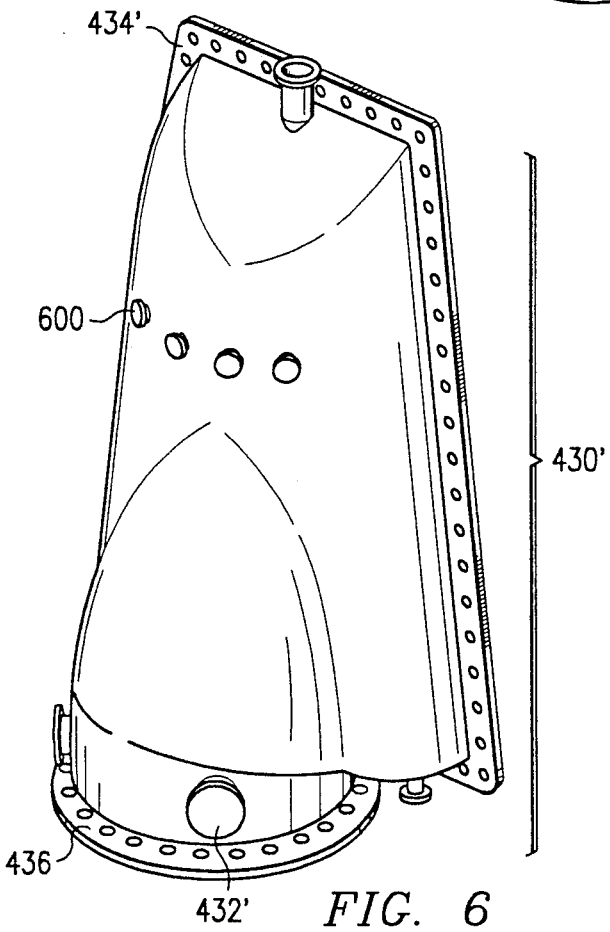
FIG. 6 shows a water box, for use at one end of one tube bundle in a large condenser like that shown in FIG. 4, with inspection ports through which a rigid inspection probe can be manually inserted to dock into one end of a tube in the condenser.

FIG. 6 shows the presently preferred embodiment of a water box, for use at one end of one tube bundle in a large condenser like that shown in FIG. 4, with inspection ports 600 through which a rigid inspection probe can be manually inserted to dock into one end of a tube 420 in the condenser. Note that the box 430' of FIG. 6 has a slightly different shape from the water box 430 of FIG. 4. Note also that the shape of the mounting flange 434' in the water box 430' of FIG. 6 is slightly narrowed at the top, unlike that of flange 434 on the water box 430 of FIG. 4. (The shape of water box 430' is that actually used in the presently preferred embodiment.) Note also that two emergency access manholes 432' are present in the water box 430' of FIG. 6, as opposed to one in the water box 430 of FIG. 4. All of these differences are believed to be immaterial.

However, one very important difference is present: note the inspection openings 600 which are present in the water box 430' of FIG. 6, and not in the water box 430 of FIG. 4. These inspection openings permit a rigid inspection probe to be inserted and docked with the end of a tube 420.

Figure 9B:
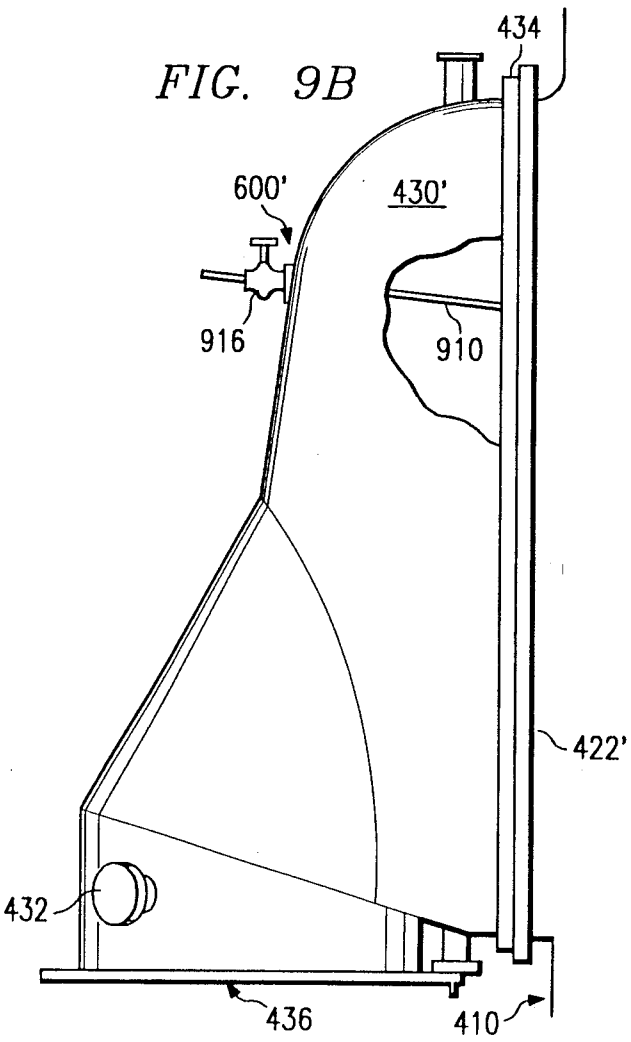
FIG. 9B shows how a rigid inspection probe can be inserted and docked with the end of a tube 420 in the end tube support 422'.

FIG. 9B shows how a rigid inspection probe can be inserted and docked with the end of a tube 420 in the end tube support 422'. Note that, in this embodiment, a slightly different form has been used for the inspection port 600: the modified inspection port 600' uses a gate valve 916 welded to the endwall of the water box. (This is the form which has been actually used in the currently working embodiment, although it is contemplated that a simple inspection plate may be preferable in the future.) The rigid probe 910 preferably has an outside diameter smaller than the inside diameter of the tubes 420, so that it can be inserted at a slight angle as shown. It is not necessary that the probe 910 make a tight contact to the tube 420; in fact, it is advantageous to have the contact somewhat loose. (Otherwise the vacuum in the oulet box may suck the water out of the tube 420, obscuring vision.)

In the presently preferred embodiment, the rigid inspection probe is made from a piece of extra-thick-wall ¾" steel tubing, with an outside diameter of about 1.1". Thus, this inspection probe has enough rigidity to be manually inserted through the water flow into the ends of the top tubes in the condenser. (Insertion into the lower tubes is more difficult; but since these tubes have a lower heat load, they are much less likely to scale, and inspection of them is less critical.)

Figure 8:
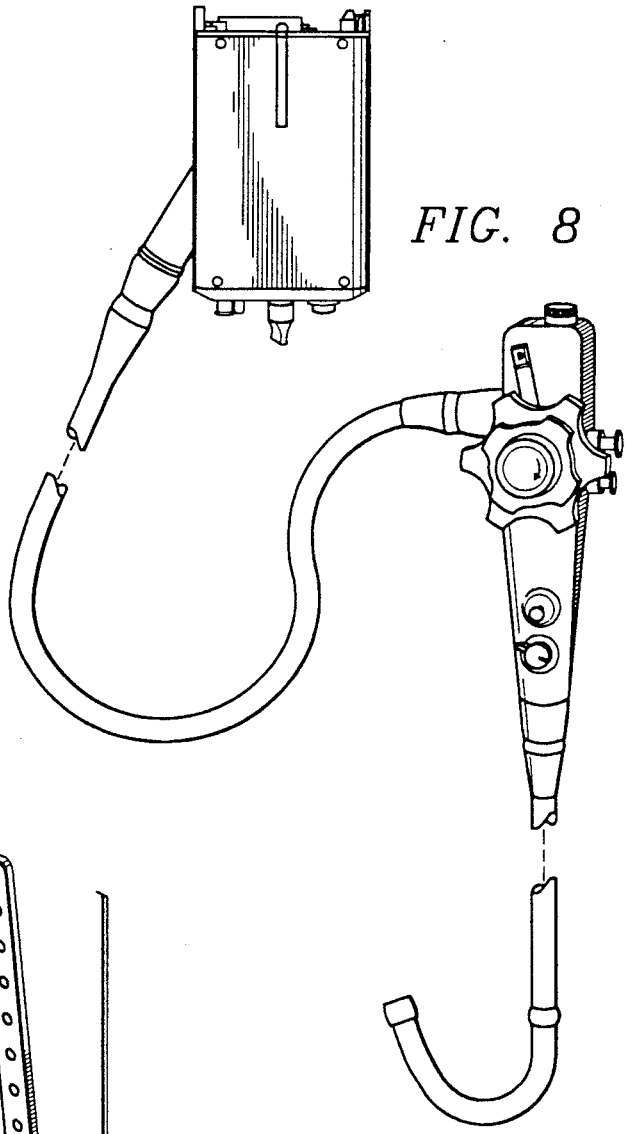
FIG. 8 shows the flexible endoscopic probe used in the presently preferred embodiment.

Once the probe 910 has been inserted and docked, an endoscopic camera, like that shown in FIG. 8, can be inserted. (The specific flexible endoscopic probe of the presently preferred embodiment is made by Welch-Allen, and is shown generally in FIG. 8; but of course other brands can be used instead).

Figure 9A:
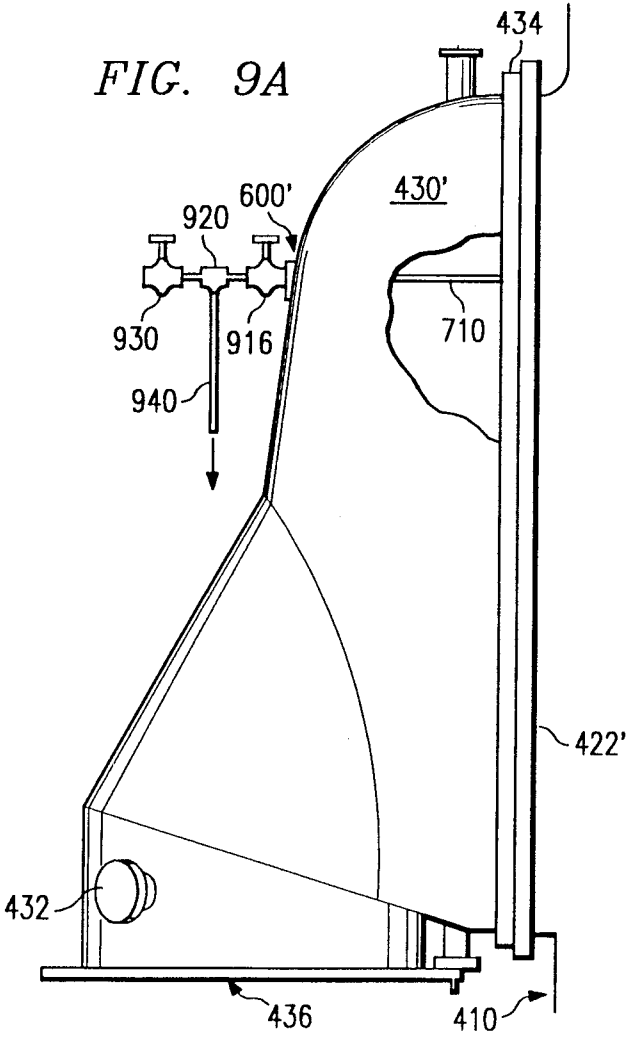
FIG. 9A shows how an isolation conduit 710 has been semipermanently emplaced through the endwall of a water box 430'.

FIG. 9A shows how an isolation conduit 710 has been semipermanently emplaced through the endwall of a water box 430'. In this embodiment, note that the isolation conduit 710—unlike the probe 910—preferably is inserted essentially straight in, i.e. coaxially aligned with the tube 420 into which the conduit 720 is inserted. This conduit 710 is shown leading into a gate valve 916, tee fitting 920, and another gate valve 930. The piping 940 provides the connection for the isolated test loop. (The complete test loop would connect to another isolation conduit 710 on the input end of the same tube 420, and also may include a chemical admixture point, a pump or flow regulator, inlet and outlet thermometers, as well as on-line chemical monitoring equipment if desired.)

Figure 7:
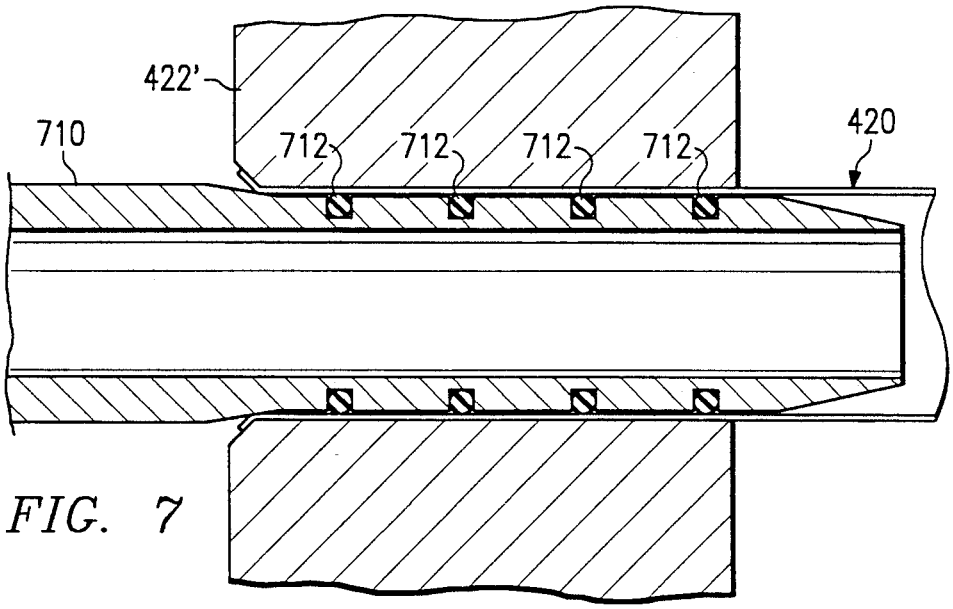
FIG. 7 is a detailed view of the tip of the isolation conduit, in the presently preferred embodiment, which mates with the monitored condenser tube.

FIG. 7 is a detailed view of the tip of the isolation conduit 710, in the presently preferred embodiment, which mates with the monitored condenser tube 420 in the end tube support 422'. Note that O-rings 712 provide hydraulic seal and some vibration isolation between the isolation conduit 710 and the condenser tube 420 where it is fitted into the end tube support 422'.

Thus, the test site has been operated both with an isolated test loop (using an isolation conduit, as shown in FIG. 9A, on both ends of a monitored condenser tube), and also with periodic in-situ in-service inspection of other tubes, using an inspection probe as shown in FIG. 9B.

The result of this has been that the test site has been successfully operated with NO anti-scaling additives, for a period of months. This has been achieved using cooling water which has a demonstrated propensity to scale. It is believed that the success in controlling scaling may be partly due to the successful control of biological fouling; but in any case the ability to precisely monitor the worst-case conditions means that the use of water-treatment chemicals can be aggressively reduced. The cost of major maintenance on a large power plant can be sizeable, partly because of the need to find replacement power. Thus, the aggressive reduction of water treatment costs would be considered to present unacceptable risks, if the disclosed innovations were not available to permit very close monitoring of worst-case degradation.

Further Modifications and Variations

It will be recognized by those skilled in the art that the innovative concepts disclosed in the present application can be applied in a wide variety of contexts. Moreover, the preferred implementation can be modified in a tremendous variety of ways. Accordingly, it should be understood that the modifications and variations suggested below and above are merely illustrative. These examples may help to show some of the scope of the inventive concepts, but these examples do not nearly exhaust the full scope of variations in the disclosed novel concepts.

For example, where a monitored condenser tube is used as a proxy for the worst-case conditions in the other condenser tubes, the inlet and outlet temperatures of the monitored tube can be checked against the temperature measurements in the water boxes. For scaling control, this permits verification that the monitored tube really is a worst case. For example, in the presently preferred embodiment, it has been discovered that the monitored tube has about 7° F. more temperature rise than the average.

For another example, where a monitored condenser tube is used as a proxy for the worst-case conditions in the other condenser tubes, it is also possible to perform chemical testing on the monitored tube in situ. Assay reagents can be used to provide early detection of microscopic changes, such as bacterial colony initiation or calcium carbonate nucleation.

For another example, where a monitored condenser tube is used as a proxy for the worst-case conditions in the other condenser tubes, it is also possible to perform on-line chemical testing on the test loop in real time. In the presently preferred embodiment, samples are taken for laboratory analysis of factors such as pH, turbidity, phosphates, phosphonates, orthophosphates, PNM alkalinity, $Ca^{++}$ concentration, $Mg^{++}$ concentration. If desired, the detailed data thus collected can be translated into any of the available scaling index numbers, such as Puckorius, Langelier's, the Ryzner index, the EPRI index, or others. Such data can be used in combination with the various solubility-product-calculation computer programs which are now available, to provide more accurate prediction for a given site.

For another example, where a monitored condenser tube is used as a proxy for the worst-case biological fouling conditions in the other condenser tubes, it is necessary to make sure that the monitored tube really is among the worst-case tubes. To ensure this, it may be desired to reduce the flow through the monitored tube, or even to add nutrients.

For another example, where a monitored condenser tube is used as a proxy for the worst-case corrosion conditions in the other condenser tubes, it is necessary to make sure that the monitored tube really is among the worst-case tubes. To ensure this, it may be desired to add acid, add brine, or even add a trickle current between the monitored tube and its contents.

For another example: to achieve semi-permanent installation of the isolation conduit 710, this conduit could be brazed into the end of the condenser tube.

For another example: to permit angled insertion of the isolation conduit 710, some flex can be added, e.g. by including a section of flexible conduit near the tip of the conduit 710.

The inspection openings in the outlet water box are preferably less than 24" wide, and ideally less than 12" wide. This permits the use of many inspection openings without degrading the mechanical strength of the water box structure. An aperture of even a few inches is sufficient for insertion of an inspectin probe like that in the presently preferred embodiment, described above.

The disclosed structures and methods could be adapted for use in heat exchangers; but it should be noted that the problems of steam condensers, and more particularly of steam-fired power plants, differ in several significant respects from those of other heat exchanger applications:

Such condensers are normally very large structures with fragile walls, which operate under very mild temperature and pressure conditions (as compared to those used in chemical refineries).

Such condensers normally operate with a relatively low temperature difference through the tube wall. Thus, any change in the thermal coupling through the tube wall is significant.

Such condensers are required to effect a large transfer of heat at near-ambient temperatures, and hence must use very large flows of cooling water; hence the cost of any water quality treatment is very high.

As will be recognized by those skilled in the art, the innovative concepts described in the present application can be modified and varied over a tremendous range of applications, and accordingly their scope is not limited except by the allowed claims.

What is claimed is:

1. A condenser system, comprising:

at least one bundle of tubes;

an inlet water box, connected to a first source of cooling water, and connected to the interiors of plural ones of said tubes;

an outlet water box, connected to the interiors of plural ones of said tubes;

a drain, connected to drain water from said outlet water box;

a steam manifold, connected to pass depleted steam over the exterior of said tubes in said bundle of tubes, whereby said steam is cooled and condensed by contact with said bundle of tubes;

a condensate removal path, connected to drain condensed steam from the exterior of said bundle of tubes;

wherein said bundle of tubes includes at least one monitoring tube, and said monitoring tube has an interior which is isolated from the water flow in both of said water boxes and which can be viewed through an endoscopic probe without shutting down said first source of cooling water, has a first end connected to a second source of cooling water, and has a second end connected to a water drain;

whereby scale deposition on the interior of tubes ins aid tube bundle can be assessed by monitoring scale deposition on the interior of said monitoring tube.

2. A steam-powered electrical generating plant, comprising:

a heat source;

a feedwater source;

a boiler, connected to receive feedwater from said feedwater source and to thermally couple said feedwater to a heat source so that said feedwater is at least partially converted into live steam;

at least one steam-powered motor, connected to receive steam from boiler and to partially convert the energy of said steam into mechanical motion;

at least one generator, connected to be powered by the mechanical motion of said motor, and to partially convert the energy of said mechanical motion into electricity;

a condenser, comprising:

at least one bundle of tubes;

an inlet water box, connected to a first source of cooling water, and connected to the interiors of plural ones of said tubes;

an outlet water box, connected to the interior of plural ones of said tubes;

a drain, connected to drain water from said outlet water box;

a steam manifold, connected to receive depleted steam from said motor, and to pass said depleted steam over the exterior of said tubes in said bundle of tubes, whereby said depleted steam is cooled and condensed by contact with said bundle of tubes;

a condensate removal path, connected to drain condensed steam from the exterior of said bundle of tubes;

wherein said bundle of tubes includes at least one monitoring tube, and said monitoring tube has an interior which is isolated from both of said water boxes and which can be viewed through an endoscopic probe without shutting down-said first source of cooling water, has a first end connected to a second source of cooling water, and has a second end connected to a water drain;

whereby scale deposition on the interior of tubes in said tube bundles can be assessed by monitoring scale depostion on the interior of said monitoring tube.

3. A method for operating a steam condenser, comprising the steps of:

providing a condenser including at least one bundle of at least 1000 condenser tubes, wherein said bundle of tubes includes at least one monitoring tube, and said monitoring tube has an interior which is isolated from both of said water boxes and which can be viewed through an endoscopic probe without shutting down said first source of cooling water, has a first end connected to a second source of cooling water, and has a second end connected to a water drain;

continually flowing cooling water, through the interior of said condenser tubes, from an inlet water box to an outlet water box;

continually flowing depleted steam across the exterior of said condenser tubes;

repeatedly, from time to time, monitoring said monitoring tube for degradation;

and admixing water treatment chemicals into said cooling water substantially continually, but only to the extent to which said step of monitoring said monitoring tube for degradation indicates that treatment is necessary to avoid degradation of said tubes of said bundle.

4. The condenser system of claim 1, further comprising:

a first treatment chemical admixture point, connected to controllably introduce chemicals into said first source of cooling water; and a second water treatment chemical admixture point, connected to controllably introduce chemicals into said second source of cooling water.

5. The condenser of claim 1, wherein less than 10% of the tubes within said bundle of tubes have respective interiors which are isolated from both of said water boxes.

6. The condenser of claim 1, wherein said bundle of tubes comprises more than 100 of said tubes.

7. The condenser of claim 1, wherein said bundle of tubes comprises more than 1000 of said tubes.

8. The condenser of claim 1, wherein said tubes in said bundle of tubes are all mounted substantially horizontally.

9. The generating plant of claim 2, wherein said heat source comprises a combustion chamber.

10. The generating plant of claim 2, wherein said boiler is heated by combustion.

11. The generating plant of claim 2, wherein said condenser includes exactly two of said tube bundles.

12. The generating plant of claim 2, wherein said outlet water box is connected so that at least some water from said outlet water box is pumped back to said inlet water box of said condenser.

13. The generating plant of claim 2, wherein said outlet water box is connected so that at least some water from said outlet water box is pumped through a cooling unit and back to said inlet water box of said condenser.

14. The generating plant of claim 2, wherein said motor comprises at least one steam turbine.

15. The generating plant of claim 2, wherein said motor consists essentially of multiple steam turbine stages.

16. The generating plant of claim 2, wherein said motor comprises a high-pressure steam turbine and a low-pressure steam turbine.

17. The generating plant of claim 2, wherein said motor comprises a high-pressure steam turbine and a low-pressure steam turbine, and wherein steam exhausted from said high-pressure steam turbine is reheated at some point between the exhaust of said high-pressure steam turbine and the inlet of said low-pressure steam turbine.

18. The generating plant of claim 2, wherein said motor comprises a high-pressure steam turbine and a low-pressure steam turbine and at least one additional turbine stage between said high-pressure steam turbine and said low-pressure steam turbine, and wherein steam exhausted from said high-pressure steam turbine is reheated at some point between the exhaust of said high-pressure steam turbine and the inlet of said low-pressure steam turbine.

19. The generating plant of claim 2, wherein said motor comprises a high-pressure steam turbine, an intermediate-pressure steam turbine, and a low-pressure steam turbine.

20. The generating plant of claim 2, wherein said feedwater source is connected to receive condensate from said condensate removal path.

* * * * *